US006059929A

United States Patent [19]

Dahl

[11] Patent Number: 6,059,929

[45] **Date of Patent: *May 9, 2000**

[54] THREE-LAYER HEADBOX

[75] Inventor: Hans Dahl, Ravensburg, Germany

[73] Assignee: Voith Sulzer Papiermaschinen GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/877,258

[22] Filed: Jun. 17, 1997

[30] Foreign Application Priority Data

Jun. 17, 1996 [DE] Germany ..... 196 24 052

[51] Int. Cl.[7] ..... D21F 1/02

[52] U.S. Cl. ..... 162/123; 162/216; 162/343; 162/347

[58] Field of Search ..... 162/123, 133, 162/212, 216, 259, 336, 343, 347

[56] References Cited

U.S. PATENT DOCUMENTS

| | | | |
|---|---|---|---|
| 4,181,568 | 1/1980 | Pfaler | 162/343 |
| 4,445,974 | 5/1984 | Stenberg | 162/300 |
| 4,824,524 | 4/1989 | Hildebrand | 162/343 |
| 5,622,603 | 4/1997 | Bergemann et al. | 162/343 |

FOREIGN PATENT DOCUMENTS

| | | |
|---|---|---|
| 1172484 | 2/1982 | Canada . |
| 2824607 | 1/1979 | Germany . |
| 3107926 | 11/1982 | Germany . |
| 2094364 | 9/1982 | United Kingdom . |
| 81 02903 | 10/1981 | WIPO . |

*Primary Examiner*—Karen M. Hastings
*Attorney, Agent, or Firm*—Ostrolenk, Faber, Gerb & Soffen, LLP

[57] ABSTRACT

A three layer headbox for producing a multilayer fiber web. The headbox has top and bottom walls inclined toward each other toward the outlet of the headbox. Top and a bottom separating blades in the headbox, the top blade defining a first chamber toward the top wall, the bottom blade being below defining a second chamber between the blades and also defining a third chamber between the bottom blade and the bottom wall. A respective pulp inlet to each of the three chambers. One of the top and bottom blades being hingedly supported at its upstream end to be adjustable in position for affecting the speed of pulp suspension in respective layers in the chambers affected by the orientation of the blade. The pulp suspension layers passing through a headbox are delivered to a paper machine forming section wire and the three streams from the headbox are combined directly before or upon impingement on the wire. Various velocities of the pulp suspension in each of the layers are obtainable and relatively adjustable with reference to each other.

15 Claims, 3 Drawing Sheets

THREE-LAYER HEADBOX

BACKGROUND OF THE INVENTION

The present invention relates to a three-layer headbox and to a method of applying a three-layer pulp slurry onto a paper machine forming section wire screen in order to produce a three-layer fiber web, in particular a paper web.

Three-layer headboxes with stationary blades between the top and bottom walls of the headbox for defining layers within the headbox are known. See, for instance, EP 0 581 051 A1. They have a problem in that different jet velocities for individual layers cannot be established at all or can be established only in part via built-in screens or only by variation of the amount or volume of suspension fed to the individual layers per unit of time. The construction of these headboxes is relatively simple, but their variability is also relatively slight.

DE-OS 37 04 462 also discloses a multi-layer headbox with blades which are swingable around their longitudinal axes between the individual nozzle spaces in order to establish speeds and pressures of the pulp slurry in the individual spaces, and the blades can be adjusted manually from the outside. This provides the advantage of great variability with respect to the adjustment of the differences in jet velocities. But it has the disadvantage that the manufacture of such a headbox is expensive, since a highly accurate mechanism per unit of time is required for adjusting the position of each blade.

There are several basic reasons for the need to control the speed of the individual layers of pulp slurry:

The formation of a paper web is a function of the differences in speed between the individual jets of pulp. The variation in the shearing forces between liquid suspension in layers which is possible in this way produces formation-affecting turbulences, which enable influencing the formation of the paper webs, if desired.

By variation of the jet velocity of an outer layer as a function of the size of the jet angle and of the jet/wire speed difference, the direction and length of the semi-axes of the breaking length ellipses of the paper web are influenced. They in turn correlate with the direction and statistical distribution of the fibers around the principal direction in the outer layer. Control of the mechanical properties of the web of paper is thus possible.

Upon drying, a web of paper undergoes preferred shrinkage in the direction transverse to the fiber layer, i.e., upon changes in moisture level and it is deformed in accordance with this property. If the fiber layer and the distribution in the outer layers of a web of paper are different, this favors so-called "curl" of a sheet, i.e. the tendency of a sheet of paper to curl upon changes in moisture. The tendency to curl can therefore also be influenced by changes in speed of the fiber layers.

SUMMARY OF THE INVENTION

The object of the invention is to provide a three-layer headbox which, on the one hand, offers the advantages of great variability of the adjustment of different speeds of the layers while, on the other hand, it can be manufactured at the lowest possible cost.

Another object of the invention is to provide a method of producing a three-layer fiber web by acting in the region of the headbox and which leads to particularly good results with respect to the layer purity, the covering of the middle layer, and the formation of a multilayer web.

The invention concerns a three layer headbox for producing a multilayer fiber web. The headbox has upper and lower outer walls which are inclined toward each other toward the outlet from the headbox. At least a first and a second separating blade extend through the headbox from the entrance to the exit. The first blade is above and defines a first chamber toward the upper wall. The second blade is below and defines a second chamber between the first and second blades and also defines a third chamber between the second blade and the lower wall. There is a respective pulp inlet to each of the three chambers. Each inlet supplies a substantially constant volume of pulp per unit time.

One of the first and second blades is hingedly supported at its upstream end in the headbox to be adjustable in position for affecting the speed of the pulp suspension in respective layers affected by the orientation of the blade.

The pulp suspension layers passing through a headbox are delivered to a paper machine forming section wire screen or wire. The three streams leaving the headbox are combined directly before or upon impingement on the wire. The hinged adjustment of the blades in the chambers adjusts the speeds of the pulp suspension in the layers in the chambers. Various velocities of the pulp suspension jets in each of the layers are obtainable and are relatively adjustable with reference to each other.

The invention provides a substantial improvement in quality, particularly layer purity, the covering of the middle layer, and the formation of a three layer paper web. Upon the introduction of the three layer pulp slurry onto the wire or into the wire wedge, i.e., the wedge between two forming wires, the jet layers remote from the forming roll have a higher speed than the jet layers close to the forming roll. To satisfy this requirement, only one of the two separating blades present in a three-layer headbox may be supported stationary while the other blade is provided with a hinged mounting at its upstream end in the headbox. This provides a three-layer headbox which, on the one hand, has the technological advantage of variable pulp jet speed but, on the other hand, it is less expensive to produce than the known headbox in which all the blades are movable. The inventors have realized that hinged mounting for movement of one of the two blades is sufficient to control the jet flow velocities in three layers.

This produces two different embodiments, leading to different distributions of the jet speeds. One embodiment of a headbox has the rigidly mounted separating blade adjacent the forming roll. In this case, the middle layer and the outer layer away from the roll have an identical jet speed which is greater than the jet speed of the inner layer toward the roll. In the other embodiment, the swingably mounted separating blade can be arranged adjacent to the forming roll. In this case, only the outer layer has a jet speed which is greater than that of the inner layer and of the middle layer.

If the position of the separating blade is positively controlled, gradation of all three speeds of the pulp slurry can also be obtained thereby.

Other features and advantages of the present invention will become apparent from the following description of the invention which refers to the accompanying drawings.

DETAILED DESCRIPTION OF EMBODIMENTS OF THE INVENTION

Figure 1:
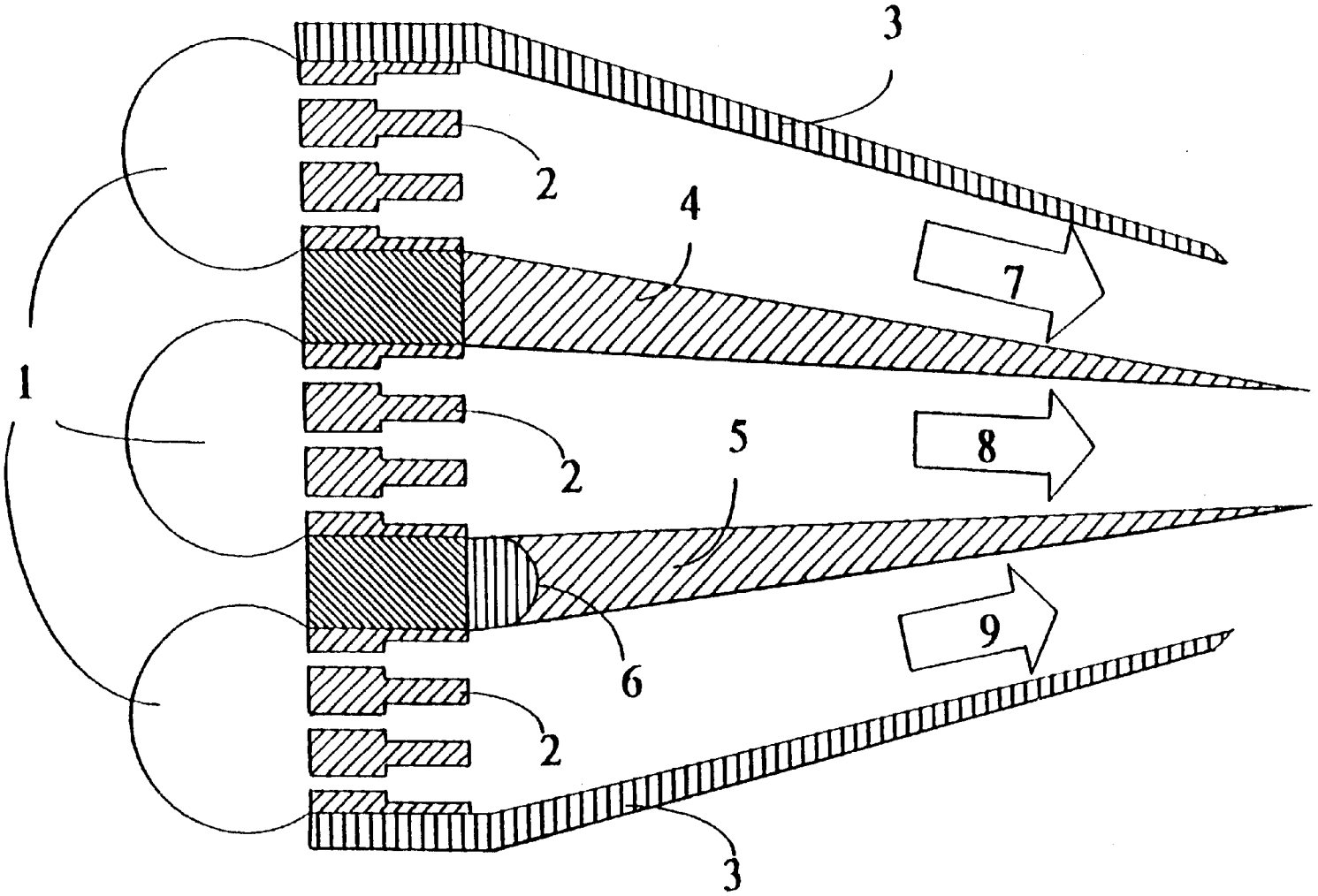
FIG. 1 shows a headbox in accordance with the invention having one rigid separating blade and a swingable separating blade.

FIG. 1 is a diagrammatic cross section through a headbox for a paper making machine which is supplied with different streams of pulp slurry via, for instance, three distributing pipes 1. The pulp slurry enters through the turbulence inserts 2 into the nozzle which is formed by the top and bottom outer walls 3 and the inner separating blades 4, 5 located between the walls. One of the separating blades 4, the one above, is mounted rigid in accordance with the invention, while the other separating blade 5, below, is swingable up and down at a swing joint 6 at the inlet end of the headbox. This produces three separate streams of pulp, the outer layer 7, middle layer 8 and inner layer 9, which have relative speeds that can be adjusted with respect to each other by the variably adjustable, swingable separating blade 5.

After passing over the blades, the slurry exits the narrowed slice end of the headbox and impinges on the wire of a forming section.

Hinged swinging of the swingable blade narrows one chamber or layer with reference at least to the other chamber or layer at the opposite surface of the swingable blade and necessarily the layer at the opposite side of the other of the blades because swinging one blade changes the heights of both adjacent chambers and of the layers therein and adjusts them relative to the third chamber and layer unaffected in size. Since the inlet of pulp suspension to each layer is at a constant rate, narrowing any chamber in height increases the velocity of jet flow therethrough, while widening the chamber in height decreases the velocity of jet flow.

Figure 2:
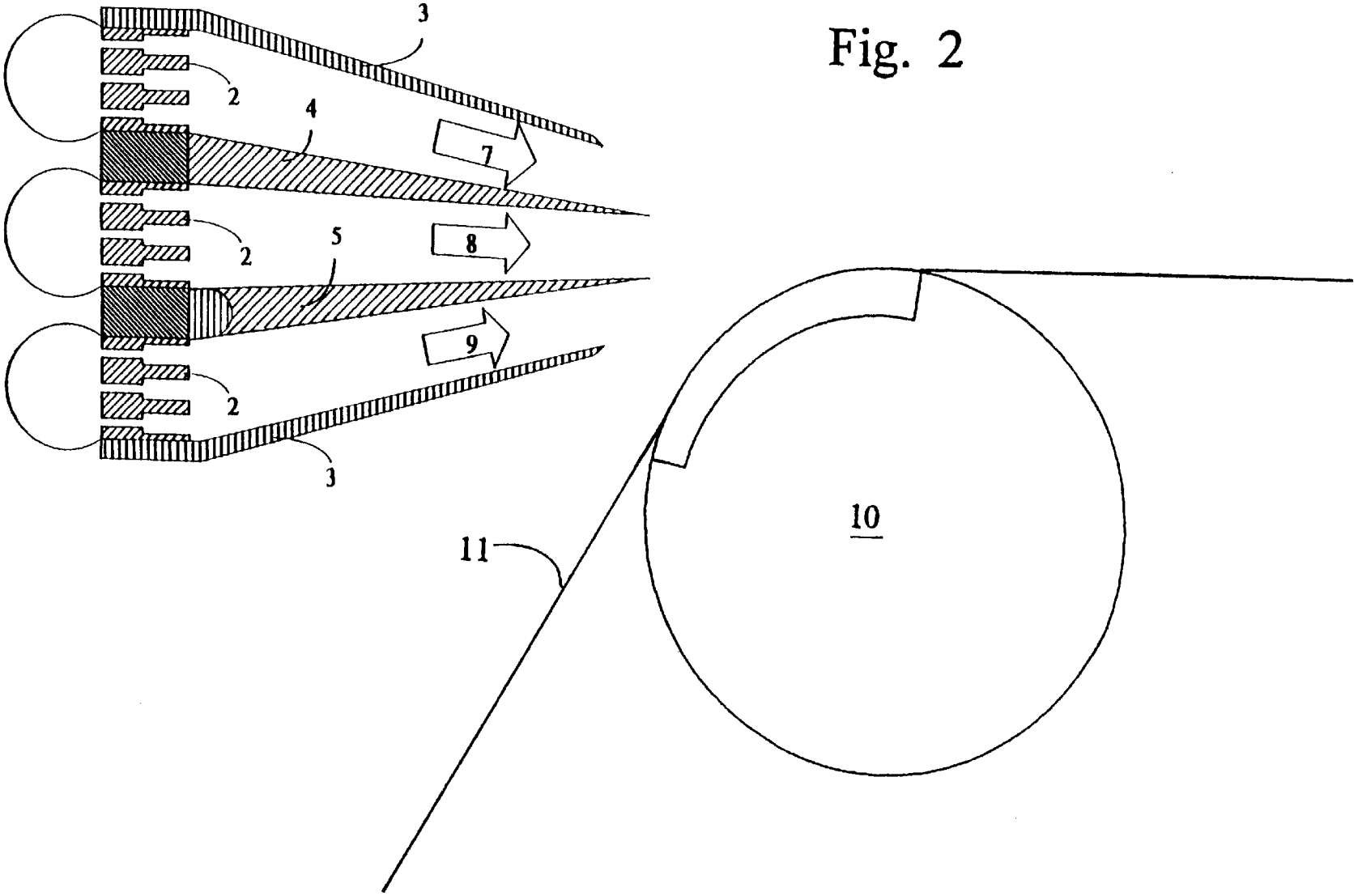
FIG. 2 shows a headbox in accordance with the invention having a swingable separating blade adjacent the forming roll.

FIG. 2 shows the headbox of the invention in greatly simplified form together with a corresponding forming roll 10 over which a paper machine forming section wire 11 travels. In this embodiment, the swingable separating blade 5 is associated with the forming roll, so that, in accordance with the invention, only the outer layer 7 is operated with a jet speed which is greater than that of the two slurry streams 8 and 9.

Figure 3:
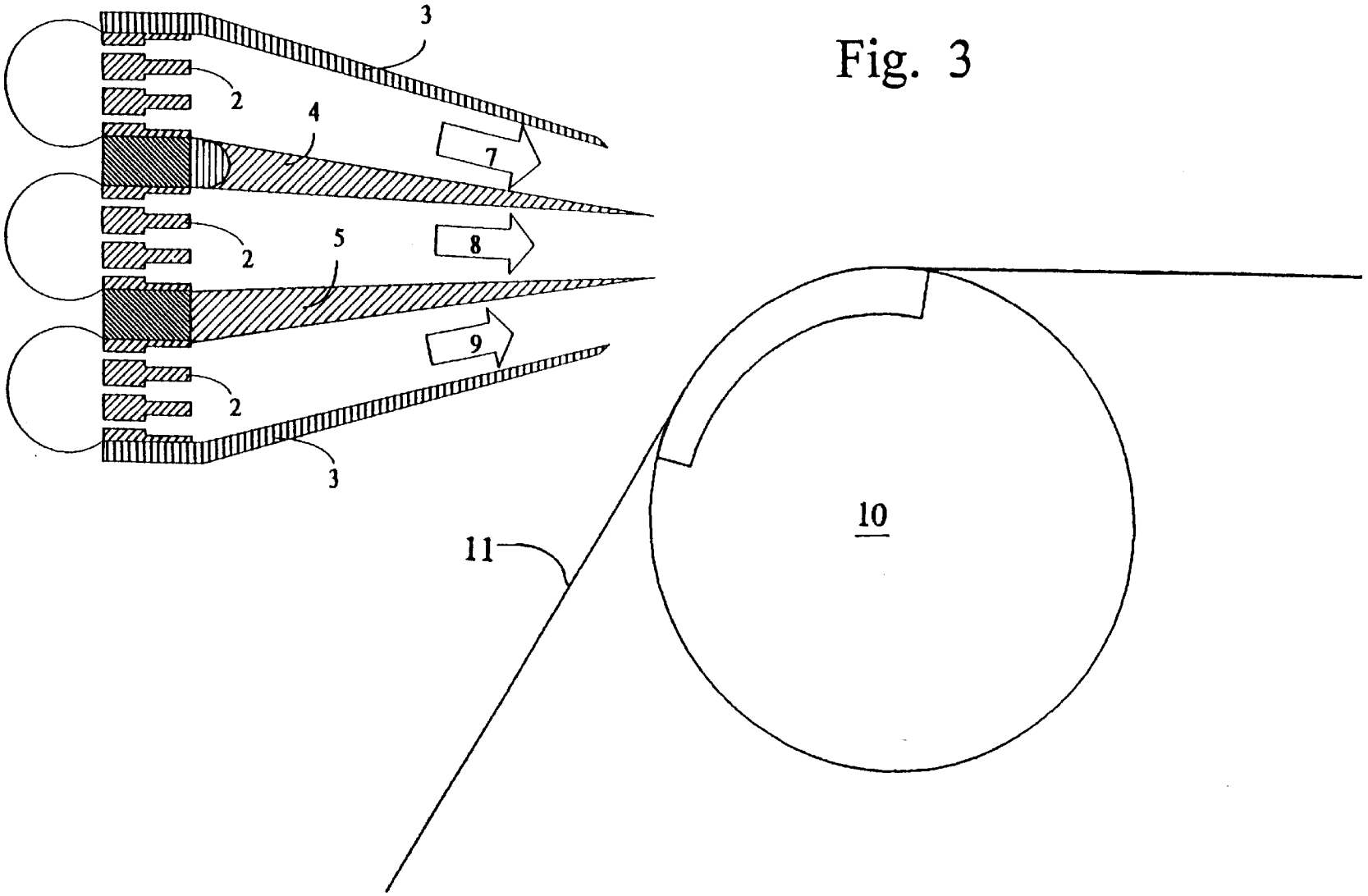
FIG. 3 shows a headbox in accordance with the invention having a rigid separating blade adjacent the forming roll.

In contrast, FIG. 3 shows the reverse situation, in which the rigidly mounted separating blade 4 is adjacent to the forming roll. With this embodiment, the middle layer 8 and the outer layer 7 can, in accordance with the invention, have the same jet speed which is greater than the jet speed, of the inner layer 9.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A headbox for producing a multilayer fiber web, the headbox comprising:

an inlet and an outlet;

top and bottom walls spaced apart and generally angled toward each other from the inlet toward the outlet and in the direction of passage of a pulp suspension through the headbox from the inlet toward the outlet and exiting the headbox outlet onto a forming roll;

first and second separating blades in the headbox between the top and bottom walls, the first blade being above and the second blade being below, the blades having upstream and downstream ends with respect to the passage of pulp through the headbox, the downstream ends terminating near the headbox outlet such that separation of the streams ends at or near the outlet;

the blades being separated from each other and for defining a first chamber between the top wall and one of the first and second blades, a second chamber between the first and second blades and a third chamber between the bottom wall and another of the first and second blades;

respective pulp suspension inlets through each of the three chambers;

one of the first and second separating blades being hingedly supported at the upstream end thereof in the headbox on an axis across the headbox for enabling adjustment of its angular orientation around the hinge upwardly or downwardly, without external means acting on the one blade, for selectively controlling the velocity of the jet flow through the respective chambers defined respectively above and below the one blade; and the other of the first and second separating blades being rigidly mounted in the headbox and not adjustable in angular orientation with reference to the headbox.

2. The headbox of claim 1, wherein the headbox includes two of the separating blades defining the first and second separating blades, with the first separating blade defining the first chamber with the top wall, the first and second blades defining the second chamber and the second blade defining the third chamber with the bottom wall.

3. The headbox of claim 2, wherein the headbox is disposed with the bottom wall thereof toward a paper machine forming section wire traveling over a forming roll, and the headbox chambers having an outlet directed toward the wire on the forming roll.

4. The headbox of claim 3, wherein the rigidly mounted separating blade is the blade adjacent to the forming roll.

5. The headbox of claim 3, wherein the hingedly supported and separating blade is the blade adjacent the forming roll.

6. A method of applying a multiple layer pulp suspension slurry to a paper machine forming section wire, wherein the machine comprises a headbox having a top wall, a bottom wall and first and second separating blades between the top and bottom walls defining a first chamber between the top wall and the upper blade, a second chamber between the two blades and a third chamber between the bottom wall and the lower blade;

the method comprising the steps of:

forming three different pulp suspension slurry streams in the headbox with one stream in each chamber and all streams extending over the width of the headbox;

entering the three different streams of pulp suspension into the first, second and third chambers respectively at the upstream end of the headbox for defining first, second and third layers, respectively;

passing the first, second and third layers through the respective chambers of the headbox;

exiting the first, second and third layers out of the exit of the headbox;

combining the three layers before or upon initial impingement of the pulp suspension on the wire of a paper machine forming section;

permitting swinging of one of the blades around the upstream end thereof, around an axis across the headbox, selectively upwardly or downwardly, without applying external force to the one blade to swing the one blade, for permitting adjustment of the speeds of the streams in the layers in the chambers separated by the one blade due to the swinging of the one blade, and while permitting swinging of the one blade, preventing swinging of the other blade; and adjusting the speeds of the slurry streams in at least one of the first, second or third layers with reference to the other layers so that the speed of the slurry stream through at least one of the layers is greater than the speed of the slurry stream through another of the layers.

7. The method of claim 6, further comprising adjusting the speeds of the slurry streams in the layers through the headbox so that the speed of the outer, first layer is greater than the speed of the inner third layer.

8. The method of claim 7, further comprising adjusting the speeds of the slurry streams in the layers through the headbox so that the speed of the middle, second layer is greater than the speed of the third inner layer.

9. The method of claim 8, further comprising adjusting the speeds of the slurry streams in the layers through the headbox so that the speed of the middle, second layer is equal to the speed of the outer, first layer.

10. The method of claim 7, further comprising adjusting the speeds of the slurry streams in the layers through the headbox so that the speed of the middle, second layer is greater than the speed of the inner, third layer and less than the speed of the outer, first layer.

11. The method of claim 6, further comprising adjusting the speeds of the slurry streams in the layers through the headbox so that the speed of the middle, second layer is equal to the speed of the third, inner layer.

12. The method of claim 6, wherein the upper one of the blades is hingedly swingable.

13. The method of claim 6, wherein the lower one of the blades is hingedly swingable.

14. A method of applying a multiple layer pulp suspension slurry to a paper machine forming section wire, wherein the machine comprises a headbox having a top wall, a bottom wall and first and second separating blades between the top and bottom walls defining a first chamber between the top wall and the upper blade, a second chamber between the two blades and a third chamber between the bottom wall and the lower blade;

the method comprising the steps of:

forming three different pulp suspension slurry streams in the headbox with one stream in each chamber and all streams extending over the width of the headbox;

entering the three different streams of pulp suspension into the first, second and third chambers respectively at the upstream end of the headbox for defining first, second and third layers, respectively;

passing the first, second and third layers through the respective chambers of the headbox;

exiting the first, second and third layers out of the exit of the headbox and combining the three layers before or upon initial impingement of the pulp suspension on the wire of a paper machine forming section;

permitting swinging of one of the blades around the upstream end thereof, around an axis across the headbox, selectively upwardly or downwardly, without applying external force to the one blade to swing the one blade, for permitting adjustment of the speeds of the streams in the layers in the chambers separated by the one blade due to the swing of the one blade, and while permitting swinging of the one blade, preventing swinging of the other blade;

adjusting the speeds of the streams through the layers separated by the one blade by swinging the one blade; and adjusting the speed of the stream through the other layer, which is not separated from another layer by the one blade but which is separated from another layer by the other blade, so that the speed of the stream through the other layer is different than the speed of the streams through the layers separated by the one blade.

15. The method of claim 14, wherein the speed through the other layer is greater than the speed through the layers separated by the one blade.

* * * * *